US009799990B2

(12) United States Patent
Szelag

(10) Patent No.: US 9,799,990 B2
(45) Date of Patent: Oct. 24, 2017

(54) PLUG CONNECTOR AND PLUG CONNECTOR SYSTEM

(71) Applicant: Tyco Electronics AMP GmbH, Bensheim (DE)

(72) Inventor: Martin Szelag, Bickenbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 192 days.

(21) Appl. No.: 14/744,959

(22) Filed: Jun. 19, 2015

(65) Prior Publication Data

US 2015/0288102 A1 Oct. 8, 2015

Related U.S. Application Data

(63) Continuation of application No. PCT/EP2013/076834, filed on Dec. 17, 2013.

(30) Foreign Application Priority Data

Dec. 19, 2012 (DE) ..... 10 2012 223 739

(51) Int. Cl.

| | |
|---|---|
| ***H01R 13/639*** | (2006.01) |
| ***H01R 13/627*** | (2006.01) |
| ***H01R 43/26*** | (2006.01) |
| *H01R 24/64* | (2011.01) |

(52) U.S. Cl.

CPC ..... *H01R 13/639* (2013.01); *H01R 13/6275* (2013.01); *H01R 13/6397* (2013.01); *H01R 43/26* (2013.01); *H01R 24/64* (2013.01)

(58) Field of Classification Search

CPC ..... H01R 13/639; H01R 13/6275; H01R 13/6397

See application file for complete search history.

(56) References Cited

U.S. PATENT DOCUMENTS

| | | | | |
|---|---|---|---|---|
| 4,078,593 | A * | 3/1978 | Benitz | B25B 23/106 81/443 |
| 6,312,277 | B1 | 11/2001 | Holub | |
| 7,544,081 | B2 | 6/2009 | Lim | |
| 8,475,197 | B2 | 7/2013 | Zerebilov et al. | |
| 2001/0027058 | A1 | 10/2001 | Pederson et al. | |
| 2006/0189197 | A1 | 8/2006 | Reed et al. | |
| 2008/0050965 | A1 | 2/2008 | Szelag et al. | |
| 2010/0112845 | A1 * | 5/2010 | Lam | H01R 13/6275 439/352 |
| 2010/0136809 | A1 | 6/2010 | Andres et al. | |

(Continued)

FOREIGN PATENT DOCUMENTS

| | | |
|---|---|---|
| CN | 200969446 Y | 10/2007 |

OTHER PUBLICATIONS

Chinese First Office Action, dated Aug. 2, 2016, 10 pages.

(Continued)

*Primary Examiner* — Briggitte R Hammond
(74) *Attorney, Agent, or Firm* — Barley Snyder

(57) ABSTRACT

A plug connector has a housing, a locking spring, and a catch spring. The locking spring is connected to the housing and has a locking position and an open position. The catch spring is connected to the housing, and has a compressed position when the locking spring is in the open position and a rest position only when the locking spring is in the open position.

24 Claims, 12 Drawing Sheets

(56) References Cited

U.S. PATENT DOCUMENTS

2011/0177710 A1* 7/2011 Tobey ..... H01R 13/514
439/345
2011/0275234 A1* 11/2011 Schmidt ..... H01R 24/64
439/345

OTHER PUBLICATIONS

Abstract of CN 200969446, dated Oct. 31, 2007, 1 page.
PCT Written Opinion and Search Report, International Application No. PCT/EP2013/076843, dated Feb. 20, 2014, 9 pages.

* cited by examiner

PLUG CONNECTOR AND PLUG CONNECTOR SYSTEM

CROSS-REFERENCE TO RELATED APPLICATION

This application claims priority under 35 U.S.C. §119(a)-(d) or (f) to International Patent Application No. PCT/EP2013/076834, dated Dec. 17, 2013, and to German Patent Application No.: DE 10 2012 223 739.9, dated Dec. 19, 2012.

FIELD OF THE INVENTION

The invention is generally related to a plug-type electrical connector, and more specifically, to a plug connector system having a locking mechanism.

BACKGROUND

Various embodiments of plug and socket electrical connector systems having plug connectors and complimentary socket mating connectors are conventionally known. Plug connector systems serve to produce releasable electrical or optical connections between the plug connectors and the socket mating connectors. Variations of the conventional plug connector systems have a locking mechanism that secures the plug connector to the socket mating connector in order to prevent unintentional or unauthorised separation of the plug connector from the socket mating connector. However, such conventional locking systems only provide limited utility, because they can often be unlocked unintentionally by normal operating actions. Unintentional separation of the plug connector and socket mating connector is thereby possible in spite of the locking mechanism.

SUMMARY

A plug connector has a housing, a locking spring, and a catch spring. The locking spring is connected to the housing and has a locking position and an open position. The catch spring is connected to the housing, and has a compressed position when the locking spring is in the open position and a rest position only when the locking spring is in the open position.

BRIEF DESCRIPTION OF THE DRAWINGS

The invention will now be described by way of example, with reference to the accompanying Figures, of which.

DETAILED DESCRIPTION

Figure 1:
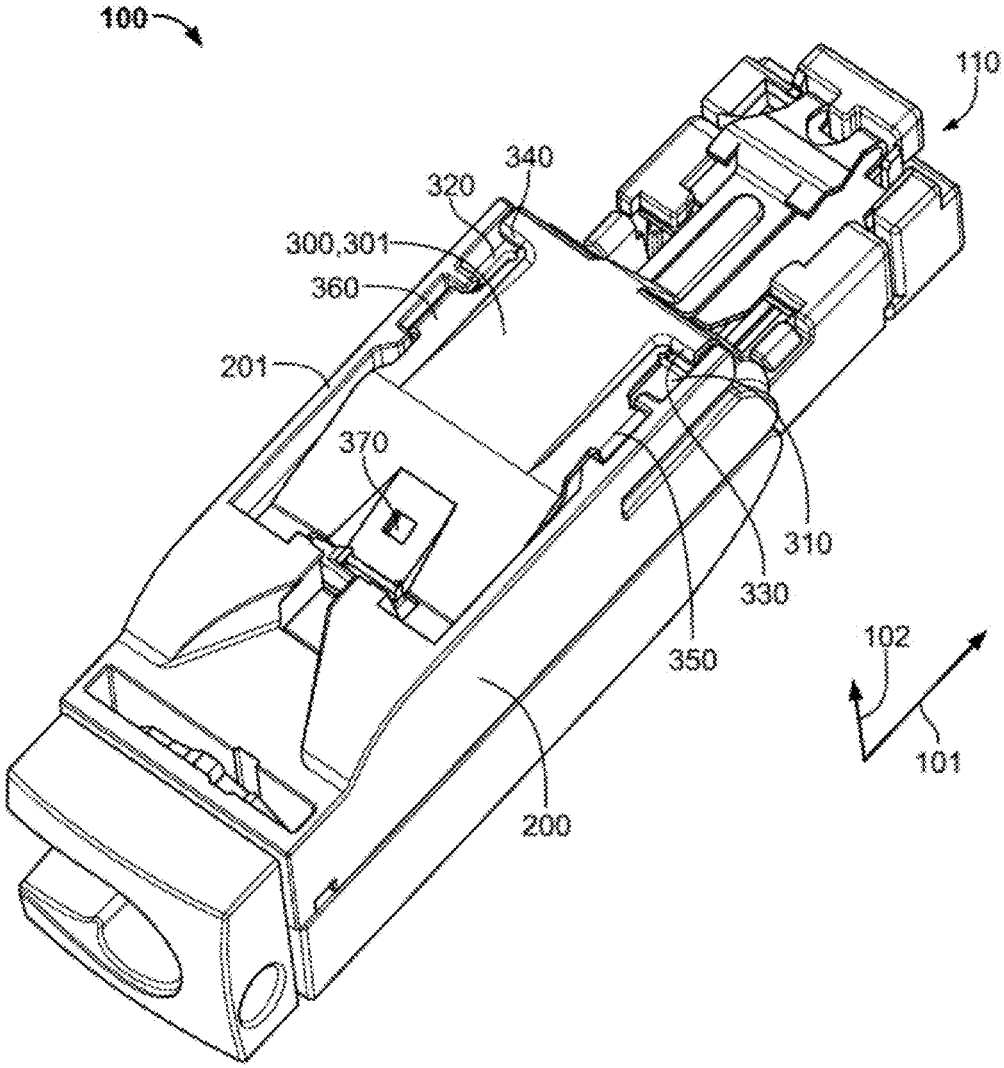
FIG. 1 is a perspective view of a plug connector.

In an embodiment shown in FIG. 1, a plug connector 100 is an electrical or an optical plug connector. The plug connector 100 transmits electrical data signals or power. In an embodiment, the plug connector 100 is an RJ plug connector, such as an RJ45 plug connector.

The plug connector 100 has a mating end 110, which is inserted in an mating direction 101 into a complimentary socket mating connector 500. A perpendicular direction 102 is orientated perpendicularly relative to a longitudinally extending axis of the mating direction 101.

The plug connector 100 has a housing 200 and a catch spring 300. The housing 200 has a first side 201, which is orientated perpendicularly relative to the perpendicular direction 102, extending in a plane parallel to the longitudinal axis of the plug connector 100. The housing 200 is made of a dielectric material, such as a plastics material. The catch spring 300 is positioned on an outer surface of the first side 201 of the housing 200. The catch spring 300 is made of a metallic material.

Figure 2:
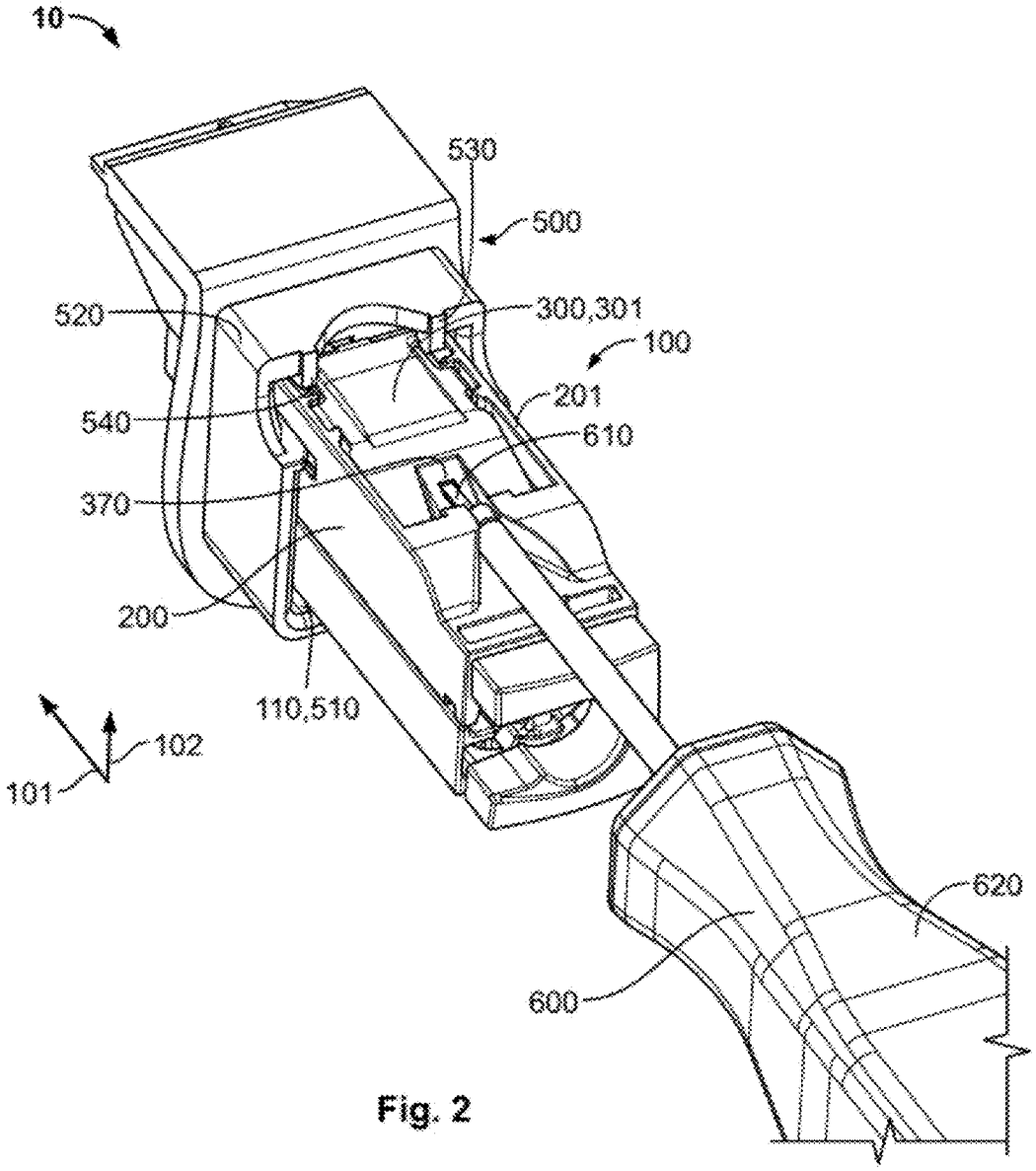
FIG. 2 is a perspective view of a plug and socket connector system having the plug connector, a socket mating connector and tool.

As shown in an embodiment of FIG. 2, a plug connector system 10 includes the plug connector 100, a complimentary socket mating connector 500, and a first locking mechanism tool 600. In an embodiment, the plug connector system 10 is an RJ plug connector system, such as an RJ45 plug connector system.

The socket mating connector 500 has an plug receiving opening 510. Furthermore, the socket mating connector 500 has a collar 520 which is arranged in a peripheral manner around the plug receiving opening 510.

The mating end 110 of the plug connector 100 has introduced into the plug receiving opening 510 of the socket mating connector 500 in order to connect the plug connector 100 to the socket mating connector 500, as shown in FIG. 2. When the plug connector 100 and the socket mating connector 500 are mated together, an optically conductive or an electrically conductive connection between the plug connector 100 and the socket mating connector 500 is established.

Figure 3:
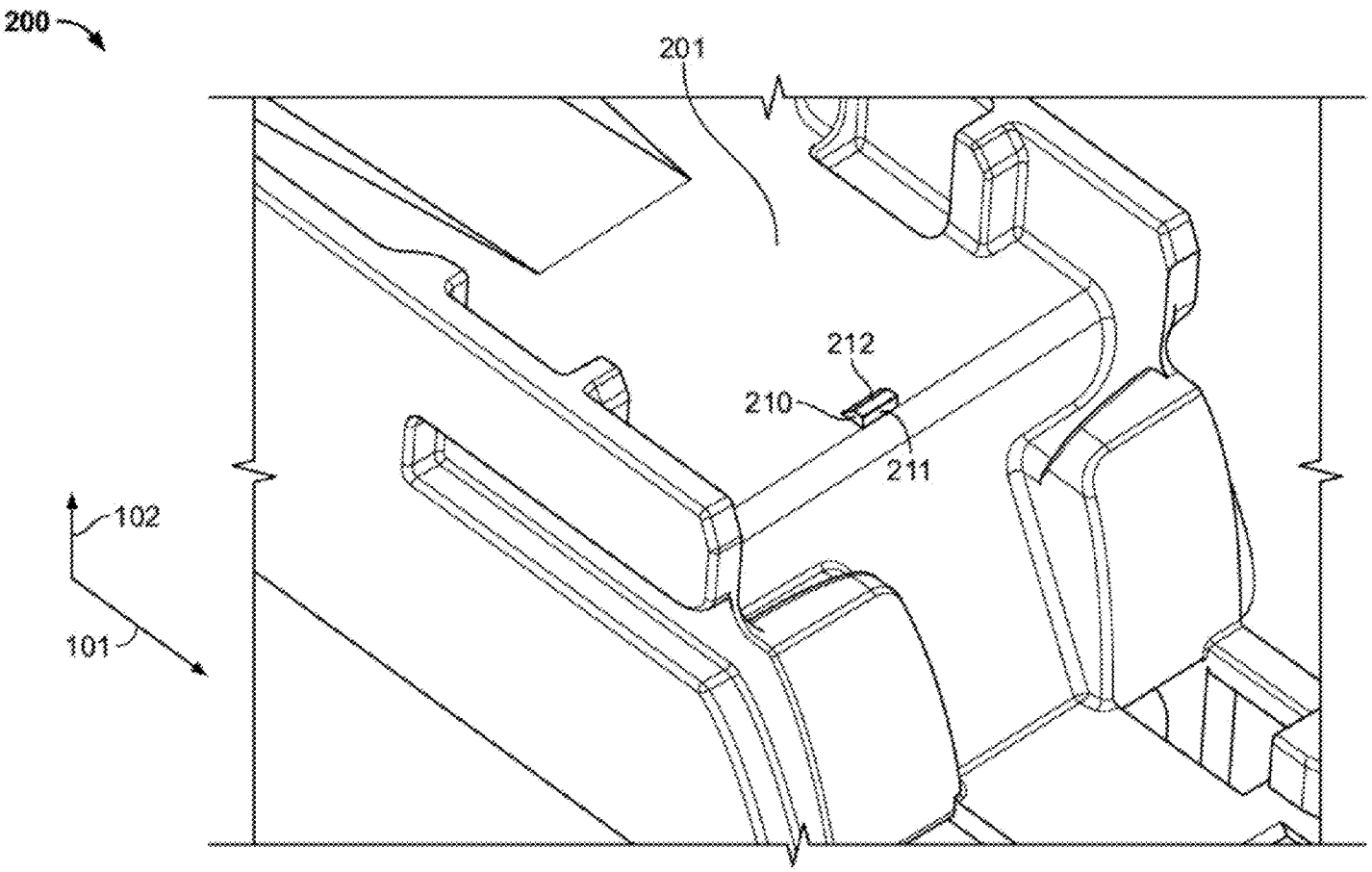
FIG. 3 is an enlarged perspective view of a housing of the plug connector.

In an embodiment shown in FIG. 3, the outer surface of first side 201 of the housing 200 has a catch projection 210. The catch projection 210 has a latching face 211 and an opposite ramp face 212. The ramp face 212 tapers down obliquely in the perpendicular direction 102 over a direction counter to the mating direction 101 (towards the mating end). The latching face 211 is positioned to face in the mating direction 101. The latching face 211 includes a chamfered portion extending orthogonally to the perpendicular direction 102.

Figure 4:
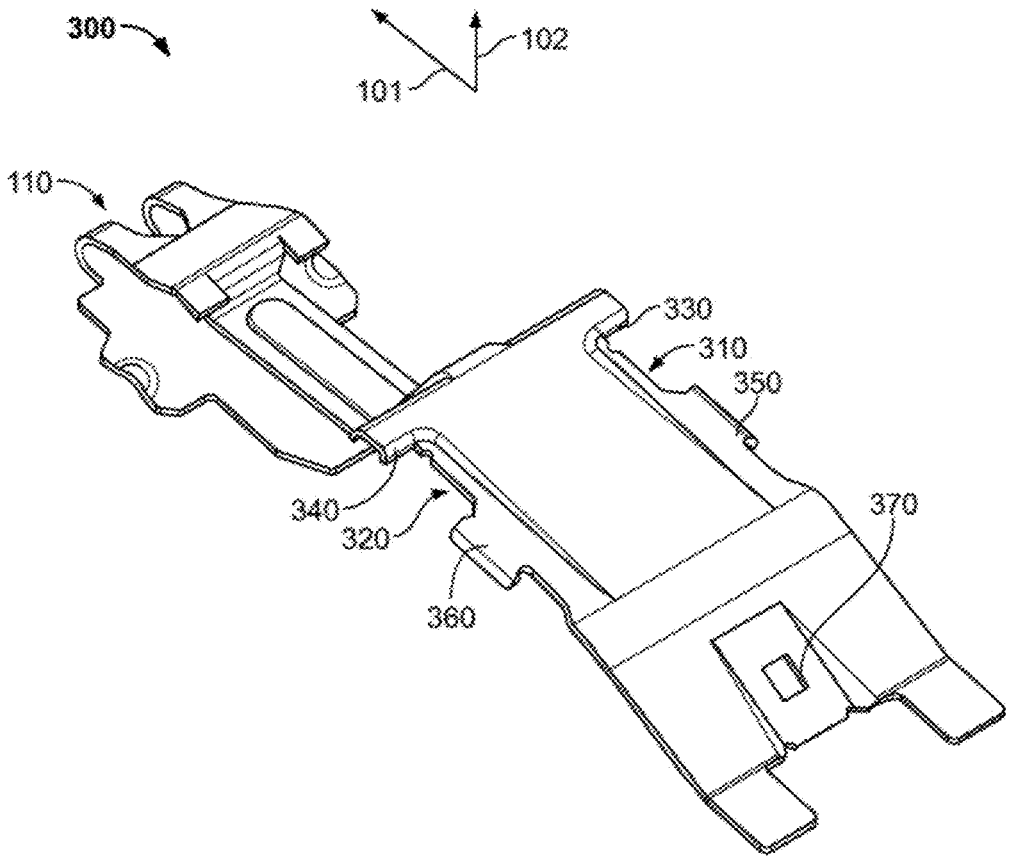
FIG. 4 is a perspective view of a catch spring of the plug connector.

In an embodiment shown in FIG. 4, the catch spring 300 of the plug connector 100 is a bent elongated metal sheet extending longitudinally in a direction corresponding to the longitudinal axis 101 of the plug connector 100.

The catch spring 300 has a first recess 310 and a second recess 320 disposed at an approximate mid-point. In a region of the catch spring 300 located between the first recess 310 and the second recess 320, the catch spring 300 is tapered in a direction perpendicular relative to the mating direction 101 with respect to the adjacent portions of the catch spring 300. In an embodiment, the first recess 310 and the second recess 320 are disposed on opposite longitudinally extending edges of the catch spring 300.

The first recess 310 has a first catch face 330 positioned on a mating end side. The second recess 320 similarly has a second latching face 340 positioned on the mating end side. The first catch face 330 and the second latching face 340 each extend perpendicularly relative to the mating direction 101 and extending outward in opposite directions from each other.

The first recess 310 has a first protuberance 350 positioned on a terminating end side opposite the mating end side. The second recess 320 of the catch spring 300 is similarly has a second protuberance 360 positioned on the terminating end side. In a region located between the protuberances 350, 360, the catch spring 300 has a greater width in the direction perpendicular relative to the mating direction 101 and the perpendicular direction 102 than in the adjacent portions of the catch spring 300.

The catch spring 370 has a centrally positioned opening 370 on the terminating end opposite the mating end 110. In an embodiment, the opening 370 has a rectangular cross-section. In other embodiments, the opening 370 has other known cross-sectional shapes.

Figure 5:
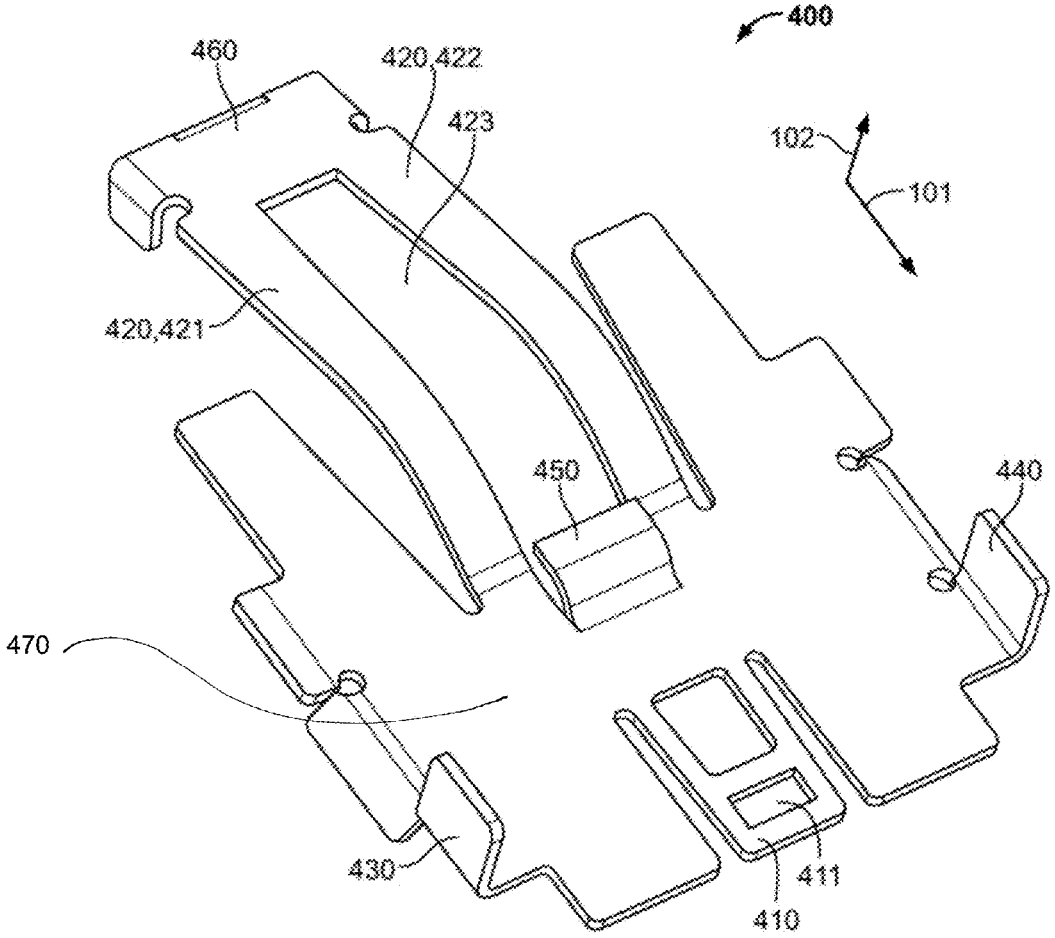
FIG. 5 is a perspective view of a locking spring of the plug connector.

In an embodiment shown in FIG. 5, a locking spring 400 of the plug connector 100 is made of a mechanically resilient material, and is a thin and partially bent metal sheet The locking spring 400 has a securing region 460 on a terminal end side. The securing region 460 serves to secure the locking spring 400 to the housing 200 of the plug connector 100.

The locking spring 400 has resilient element 420 extending continuously from the securing region 460 towards a mating end side opposite the terminating end side. The resilient element 420 is a cantilevered bar spring have a first resilient bar 421 and a second resilient bar 422. The first resilient bar 421 and the second resilient bar 422 extend parallel with each other in the mating direction 101. The resilient bars 421, 422 of the resilient element 420 are prebent in such a manner that, in a relaxed state, they each have a curvature orientated in the perpendicular direction 102. A guiding region 423 is disposed between the first resilient bar 421 and the second resilient bar 422.

The mating end of the resilient element 420 opposite the securing region 460 is continuously connected to a planar spring body 470 of the locking spring 400. The planar portion has a projection engaging tongue 410 at the front longitudinal end of the locking spring 400 in the mating direction 101. The projection engaging tongue 410 has a projection receiving opening 411 which is constructed as an aperture in the projection engaging tongue 410. The projection receiving opening 411 extends a distance along the longitudinal axis. A cross-sectional face of the projection engaging tongue 411 is dimensioned to be complimentary to the catch projection 210, the catch projection 210 being receivable into the projection receiving opening 411.

The spring body 470 further has a first wing 430 and a second wing 440. The first wing 430 and the second wing 440 are oriented parallel with the mating direction 101, are positioned on mutually opposing side edges of the locking spring 400, and are bent approximately perpendicular relative to the planar portion of the locking spring 400 in each case in such a manner that the first wing 430 and the second wing 440 extend in the perpendicular direction 102.

The spring body 470 further has an tool engaging tongue 450. The tool engaging tongue 450 is positioned adjacent to the resilient element 420, extending from the spring body 470 toward the guiding region 423 between the first resilient bar 421 and the second resilient bar 422. In an embodiment, the tool engaging tongue 450 is slightly raised in the perpendicular direction 102 with respect to the spring body 470. However, in other embodiments, the tool engaging tongue 450 can be constructed differently. The tool engaging tongue 450 is provided as an engagement location in order to apply a force in the mating direction 101 to the spring body 470.

Figure 6:
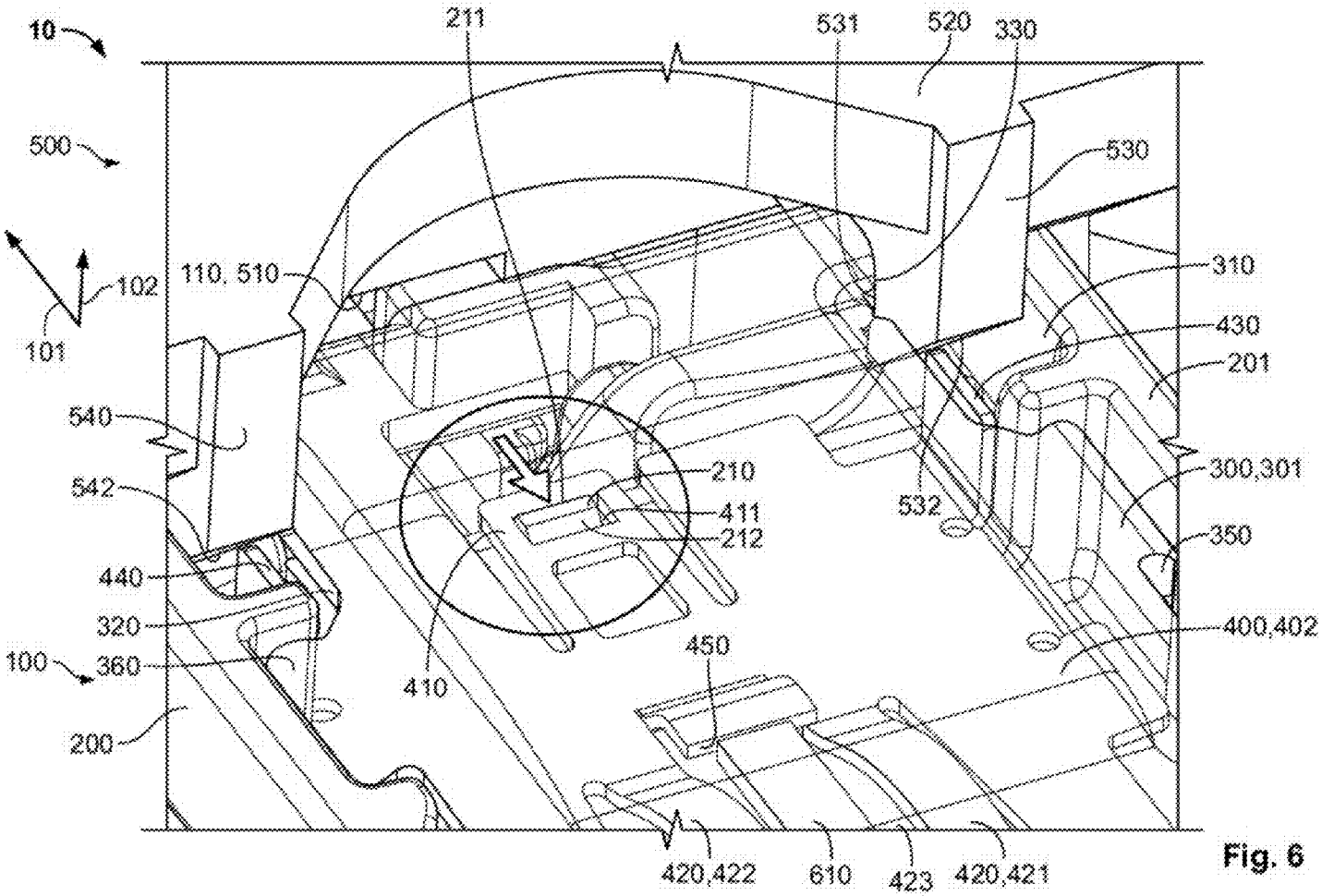
FIG. 6 is a perspective view of the plug connector system in a state where the plug connector is partially mated to the socket mating connector.

In an embodiment shown in FIG. 6, the plug connector 100 is partially mated to the socket mating connector 500. The collar 520 and the plug receiving opening 510 of the socket mating connector 500 are shown, where the mating end 110 of the plug connector 100 is positioned in the plug receiving opening 510 of the socket mating connector 500.

The catch spring 300 of the plug connector 100 is shown in FIG. 6 in a semi-transparent manner, with the locking spring 400 being positioned below the catch spring 300, and between the housing 200 and the catch spring 300.

The collar 520 of the socket mating connector 500 has a first latch 530 and a second latch 540. The first latch 530 and the second latch 540 each extend from the collar 520 partially over the plug receiving opening 510. The first latch 530 has a first latching face 531 which is directed towards the inner side of the socket mating connector 500. Similarly, the second latch 540 has a second latching face 541 which faces the inner side of the socket mating connector 500. The first latching face 531 and the second latching face 541 are consequently orientated in the mating direction 101. In addition, the first latch 530 has a first inclined surface 532 which is orientated in an inclined manner counter to the mating direction 101 and the perpendicular direction 102. The second latch 540 has in a symmetrical manner a second inclined surface 542 which is orientated in a similar manner.

The first catch face 330 of the catch spring 300 of the plug connector 100 is engaged behind the first latch 530 on the first latching face 531. Accordingly, the second latching face 340 of the catch spring 300 is also engaged behind the second latch 540 on the second latching face 541. Owing to the engagement of the latching faces 330, 340 of the catch spring 300 of the plug connector 100 behind the latches 530, 540 of the collar 520 of the socket mating connector 500, the plug connector 100 is fixed to the socket mating connector 500 and secured against being removed from the plug receiving opening 510 of the socket mating connector 500.

During the introduction of the mating end 110 of the plug connector 100 in the plug receiving opening 510 of the socket mating connector 500, the catch spring 300 was pressed by the inclined surfaces 532, 542 of the latches 530, 540 of the socket mating connector 500 from a rest position 301 of the catch spring 300 (shown in FIG. 6) resiliently in the direction counter to the perpendicular direction 102, into a compressed position 302. In the compressed position 302, the catch spring 300 can slide past the latches 530, 540 of the socket mating connector 500. After the latching faces 330, 340 have passed the latches 530, 540, the resiliently deformed catch spring 300 move from the compressed position 302, back into the rest position 301 shown in FIG. 6. In the rest position 301, the latching faces 330, 340 of the catch spring 300 now adjoin the latching faces 531, 541 of the latches 530, 540 of the socket mating connector 500, whereby the plug connector 100 is engaged with the socket mating connector 500.

The movement of the catch spring 300 from the rest position 301 into the compressed position 302 during mating of the plug connector 100 and socket mating connector 500 is possible by the fact that the locking spring 400 of the plug connector 100 was located in an open position 402 while the plug connector 100 and socket mating connector 500 were being joined together. In the open position 402 of the locking spring 400, the projection engaging tongue 410 of the locking spring 400 is engaged on the catch projection 210 at the first side 201 of the housing 200. In this instance, an edge of the projection receiving opening 411 adjoins the latching face 201 of the catch projection 210. The resilient element 420 is resiliently tensioned in the open position 402 of the locking spring 400. In this instance, the resilient bars 421, 422 of the resilient element 420 extend in the mating direction 101. The securing region 460 of the locking spring 400 is rigidly connected to the housing 200 of the plug connector 100. The resilient bars 421, 422 in the open position 402 thereby apply a force which is orientated in the direction counter to the mating direction 101 to the projection engaging tongue 410 of the locking spring 400.

Figure 7:
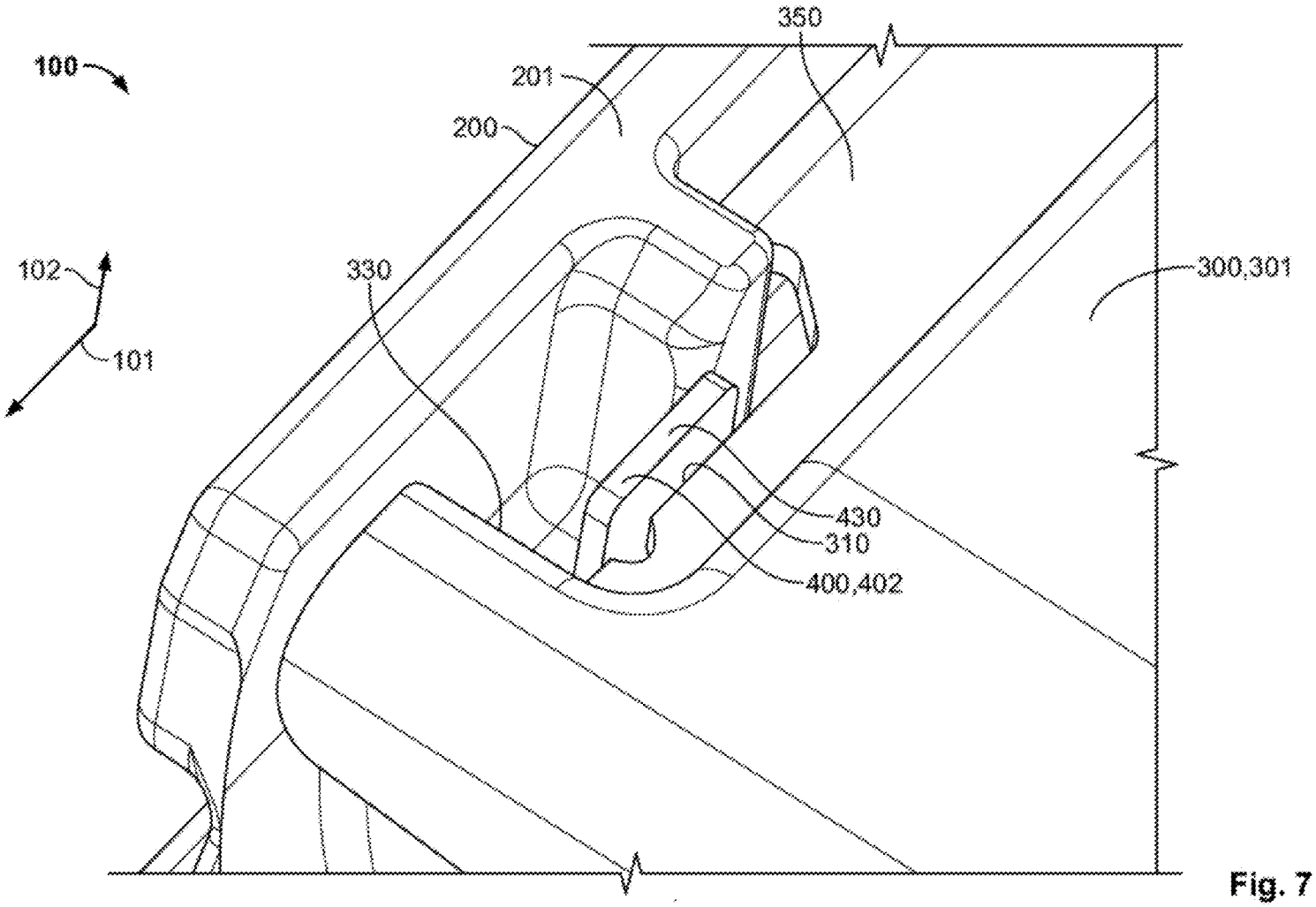
FIG. 7 is an enlarged view of the catch spring and the locking spring of the plug connector located in an open position.

In the open position 402 of the locking spring 400, the first wing 430 and the second wing 440 of the locking spring 400 are arranged in such a manner movement of the catch spring 300 from the rest position 301 into the compressed position 302 is not blocked. In an embodiment shown of FIG. 7, when the locking spring 400 is in the open position 402, the first wing 430 of the locking spring 400 is positioned in the region of the first recess 310 of the catch spring 300. Accordingly, in the opening position 402, the second wing 440 of the locking spring 400 is positioned in the region of the second recess 320 of the catch spring 300. If the catch spring 300 is pressed from the rest position 301 into the compressed position 302 whilst the locking spring 400 is located in the open position 402, the recesses 310, 320 of the catch spring 300 slide past the wings 430, 440 of the locking spring 400.

If the plug connector 100 is pressed from the partially mated position (shown in FIG. 6), further into the plug receiving opening 510, the inclined surfaces 532, 542 of the latches 530, 540 of the socket mating connector 500 contact the first wing 430 and the second wing 440 of the locking spring 400 and apply a force which is orientated in the direction counter to the mating direction 101.

This force, acting on the locking spring 400 in the direction counter to the mating direction 101, releases the projection receiving opening 411 of the projection engaging tongue 410 from the catch projection 210 of the housing 200. The release of the projection receiving opening 411 from the projection engaging tongue 410 is supported by the chamfering of the latching face 211 of the catch projection 210. The projection engaging tongue 410 of the locking spring 4000 is thereby disengaged. The locking spring 400 moves from the open position 402 in the direction counter to the mating direction 101 into an intermediate position.

As soon as the catch spring 300 has returned from the compressed position 302 completely into the rest position 301 thereof, and the protuberances 350, 360 of the catch spring 300 are thereby located above the wings 430, 440 of the locking spring 400 in a perpendicular direction 102. Additionally, the locking spring 400 is moved by the resiliently relaxing resilient bars 421, 422 from the intermediate position further into a locking position 401. In this instance, the projection engaging tongue 410 of the locking spring 400 moves further in the direction counter to the mating direction 101.

Figure 8:
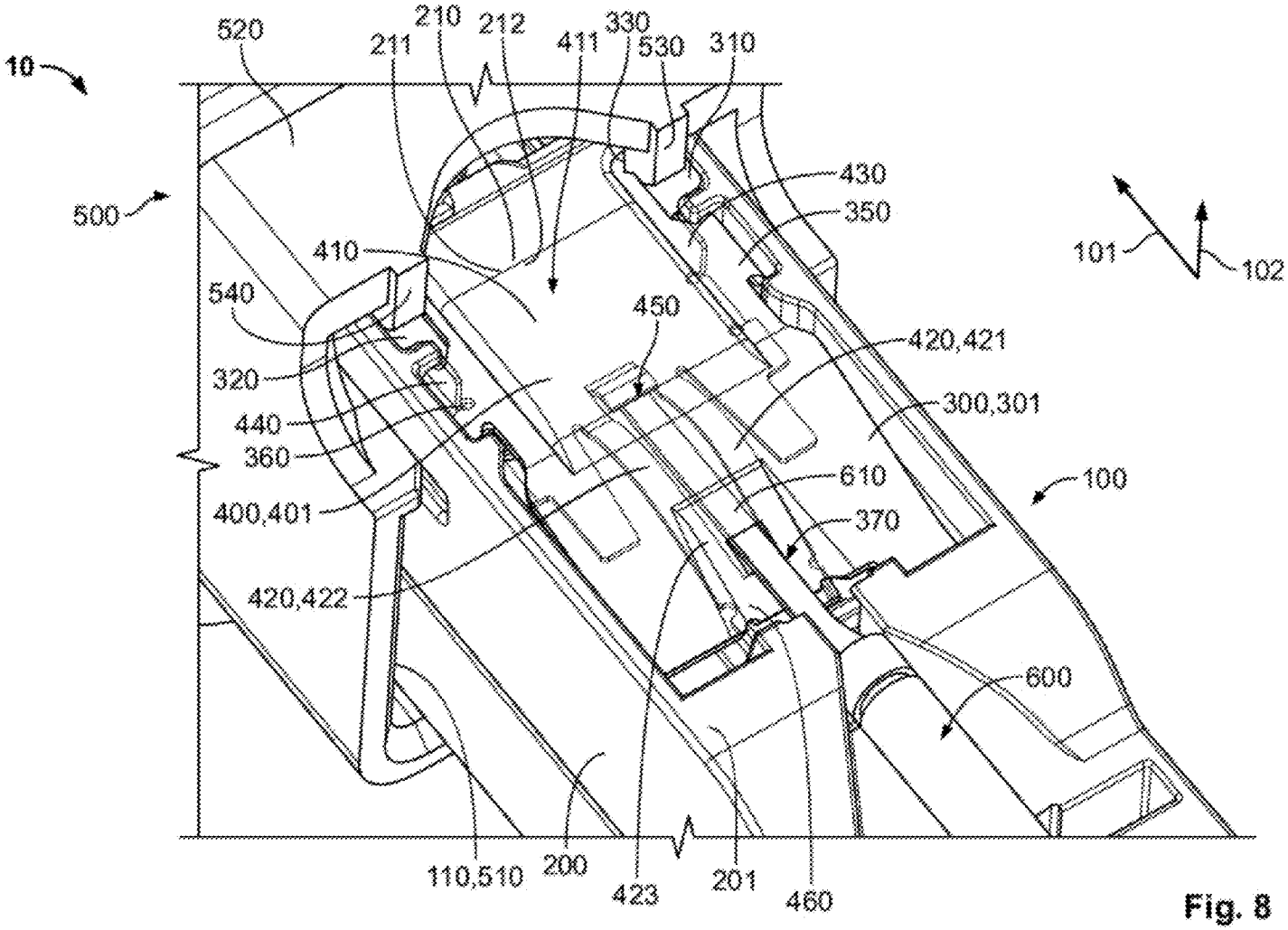
FIG. 8 is an enlarged view of the plug connector system in a locked position.

In an embodiment shown in FIG. 8, the locking spring 400 is in the locking position 401. The projection engaging tongue 410 is released from the catch projection 210 of the housing 200, and the resilient bars 421, 422 are resiliently relaxed.

Figure 9:
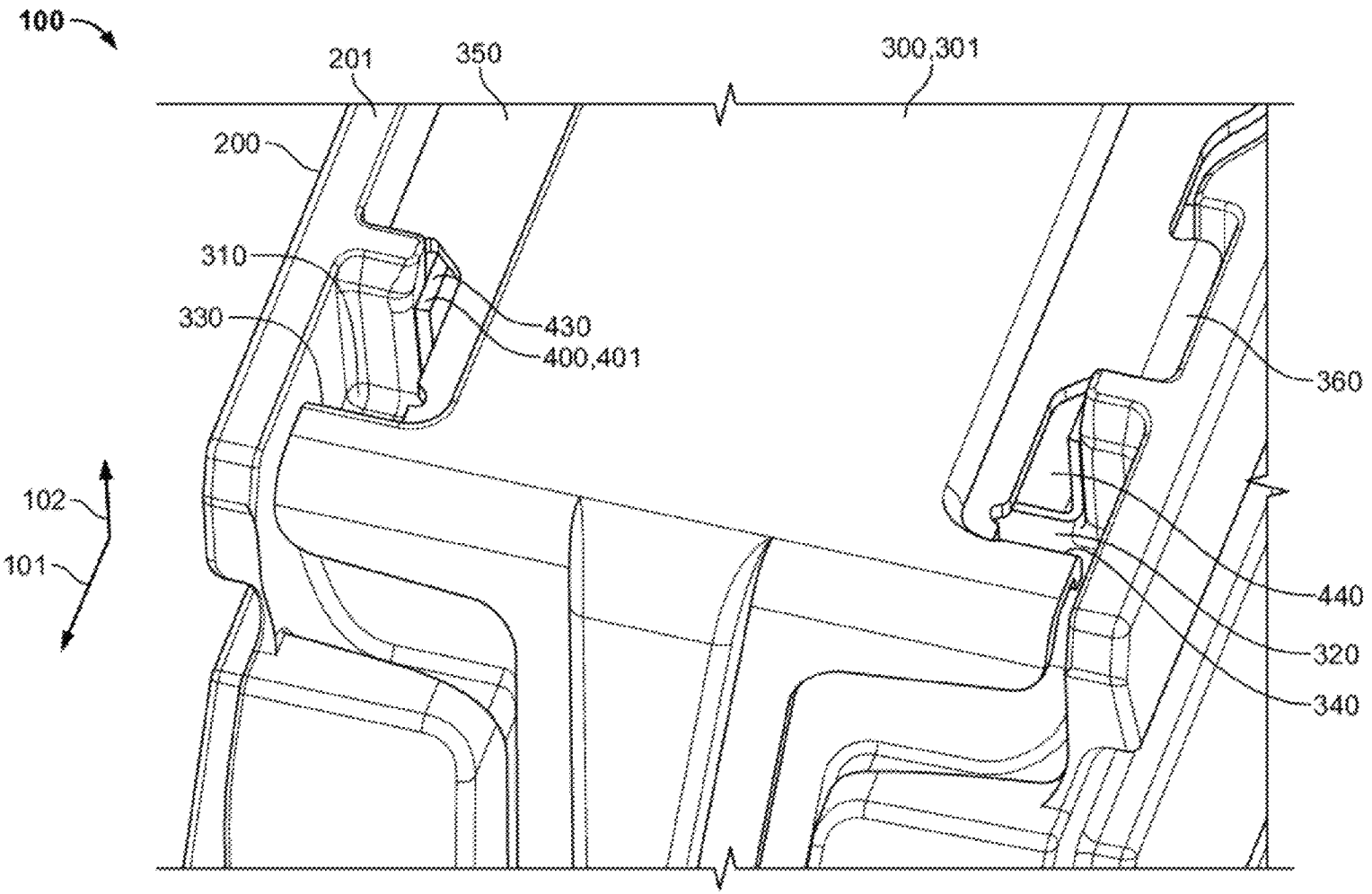
FIG. 9 is an enlarged view of the catch spring and the locking spring of the plug connector in the locked position.
Figure 10:
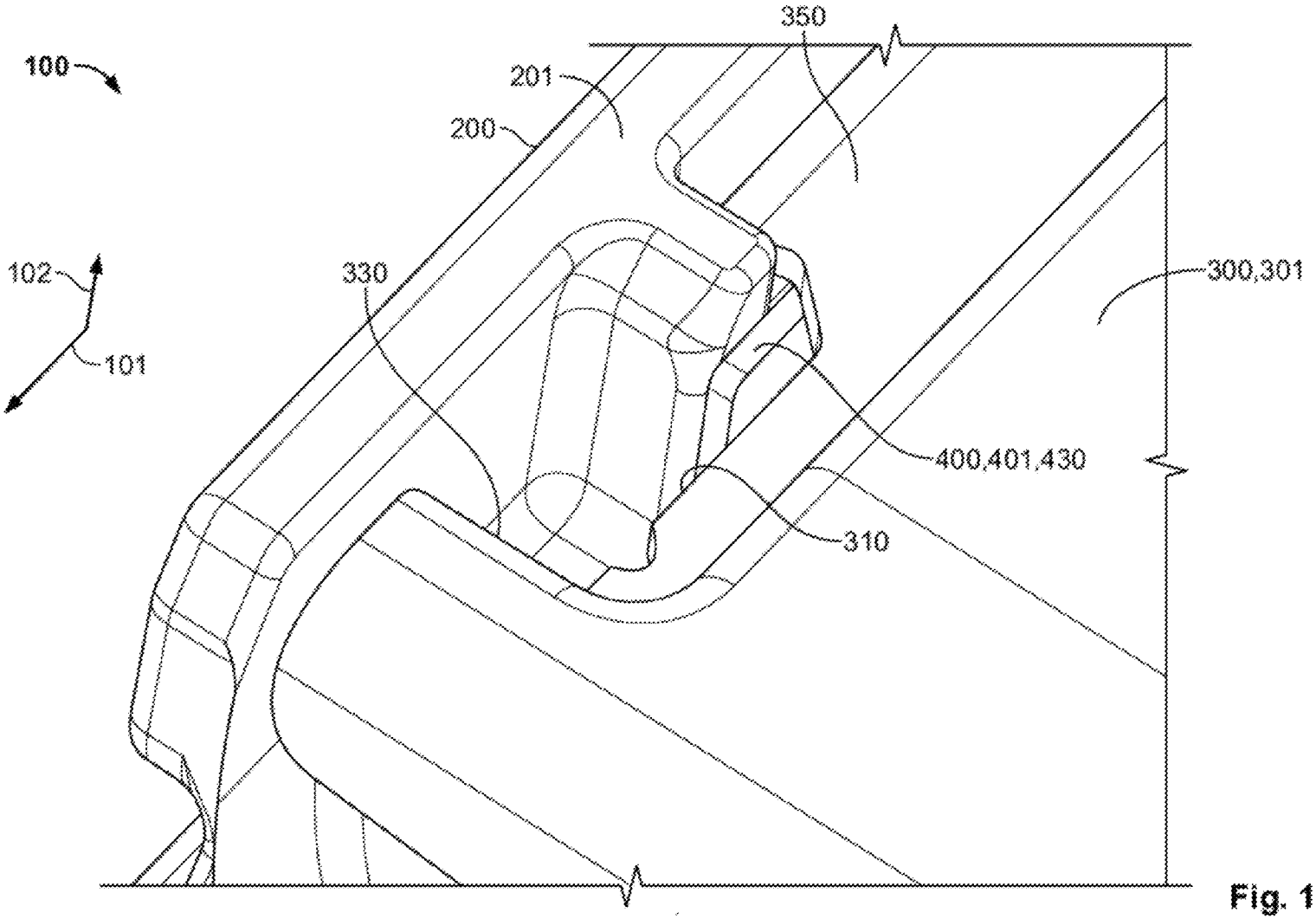
FIG. 10 is an enlarged view of the catch spring and the locking spring of the plug connector in the locking position.

In the embodiments shown in FIGS. 9 and 10, the locking spring 400 is in the locking position 401. The socket mating connector 500 is not shown in FIGS. 9 and 10 for the sake of simplicity.

When in the locking position 401, the first wing 430 and the second wing 440 of the locking spring 400 are positioned in a perpendicular direction 102 below the first protuberance 350 and the second protuberance 360 of the catch spring 306, which is located in the rest position 301 thereof. A movement of the catch spring 300 from the rest position 301 to the compressed position 302 is prevented by the wings 430, 440 of the locking spring 400. A movement of the catch spring 300 in the direction counter to the perpendicular direction 102, would result in the protuberances 350, 360 of the catch spring 300 striking the wings 430, 440.

Since, in the locking position 401, a movement of the catch spring 300 from the rest position 301 into the compressed position 302 is consequently made impossible, engagement between the latching faces 330, 340 of the catch spring 300 and the latching faces 531, 541 of the latches 530, 540 of the socket mating connector 500 cannot be released. Removal of the plug connector 100 from the plug opening 510 of the socket mating connector 500 is thereby prevented. The plug connector 100 is consequently engaged or locked by the catch spring 300 in the plug receiving opening 510 of the socket mating connector 500, this locking action being additionally ensured by the locking spring 400 in the locking position 401.

In order to separate the plug connector 100 from the socket mating connector 500, the locking spring 400 of the plug connector 100 must firstly be moved from the locking position 401 into the open position 402. The resilient bars 421, 422 of the resilient element 420 of the locking spring 400 are tensioned in this instance. In the open position 402 of the locking spring 400, the projection engaging tongue 410 is engaged on the catch projection 210 of the plug connector 100 by the projection receiving opening 411 of the projection engaging tongue 410 being moved over the catch projection 210. This is facilitated by the chamfered ramp face 212 of the catch projection 210. If the locking spring 400 is located in the open position 402, the catch spring 300 has moved from the rest position 301 into the compressed position 302. In the compressed position 302, the latching faces 531, 542 of the socket mating connector 500 are no longer in abutment with the latching faces 330, 340 of the catch spring 300. Removal of the plug connector 100 from the plug receiving opening 510 of the socket mating connector 500 is thereby enabled.

A first locking mechanism tool 600 serves to move the locking spring 400 from the locking position 401 into the open position 402. The first locking mechanism tool 600 has an operating handle 620 and a blade 610. An operator can introduce the blade 610 through the opening 370 in the catch spring 300 in an mating direction 101 inside the plug connector 100. In this instance, the blade 610 of the first locking mechanism tool 600 is guided in the guiding region 423 of the locking spring 400 between the first resilient bar 421 and the second resilient bar 422 of the resilient element 420. At the mating end of the guiding region 423, the blade 610 of the first locking mechanism tool 600 contacts the tool engaging tongue 450 of the locking spring 400. Using the first locking mechanism tool 600, the operator can apply a force directed in the mating direction 101 to the tool engaging tongue 450 to move the projection engaging tongue 410 in the direction of the catch projection 210 of the housing 200.

Figure 11:
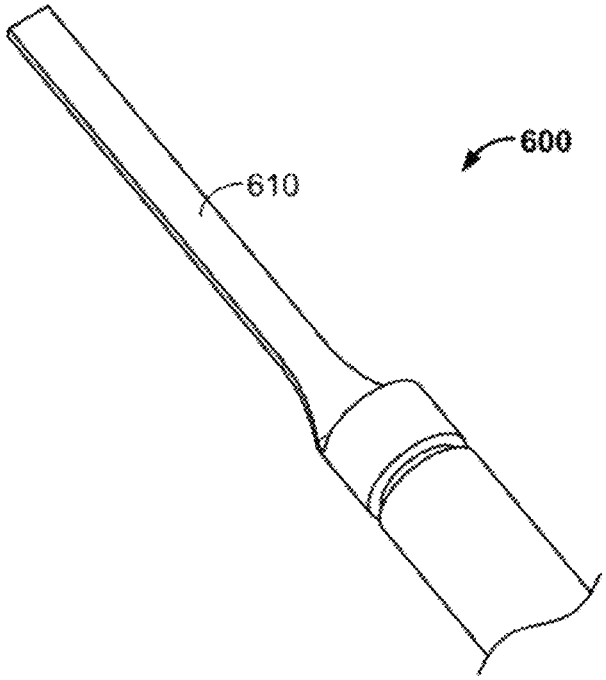
FIG. 11 is a perspective view of a first locking mechanism tool.
Figure 12:
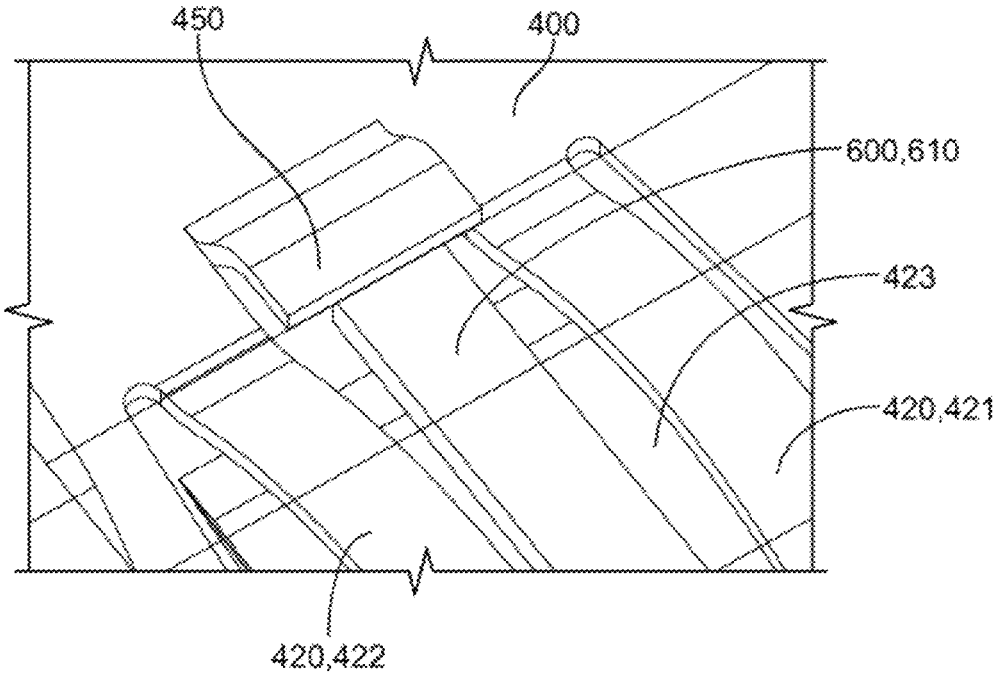
FIG. 12 is a perspective view of a portion of the first locking mechanism tool engaging the locking spring.

FIG. 11 shows a detailed view of an embodiment of the blade 610 have a flat bar-shape. In an embodiment shown in FIG. 12, the blade 610 is engaged with the tool engaging tongue 450 of the locking spring 400, the blade 610 being position in the guiding region 423. The opening 370 in the catch spring 300 has a cross-section which corresponds to the cross-section of the blade 610. Thus, only the blade 620 can be introduced into the plug connector 100, while precluding the use of other tools. Unauthorized and unintended movement of the locking spring 400 from the locking position 401 into the open position 402, and thereby unintended separation of the plug connecter 100 from the socket mating connector 500 is made more difficult or prevented. In an embodiment (not shown), the tool engaging tongue 450 lacks the bent portion in the plane in order to facilitate the interaction with the tool blade 610.

Figure 13:
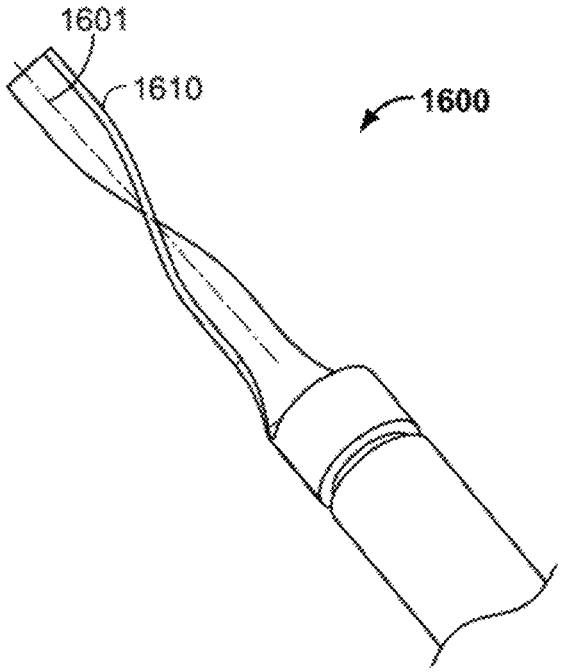
FIG. 13 is a perspective view of a second locking mechanism tool.

In an embodiment shown in FIG. 13, a second locking mechanism tool 1600 has a twisted blade 1610 which is twisted or rotated about a longitudinal axis 1601. The basic form of the twisted blade 1610 is also that of a flat bar, which is, however, additionally twisted about the longitudinal axis 1601.

Figure 14:
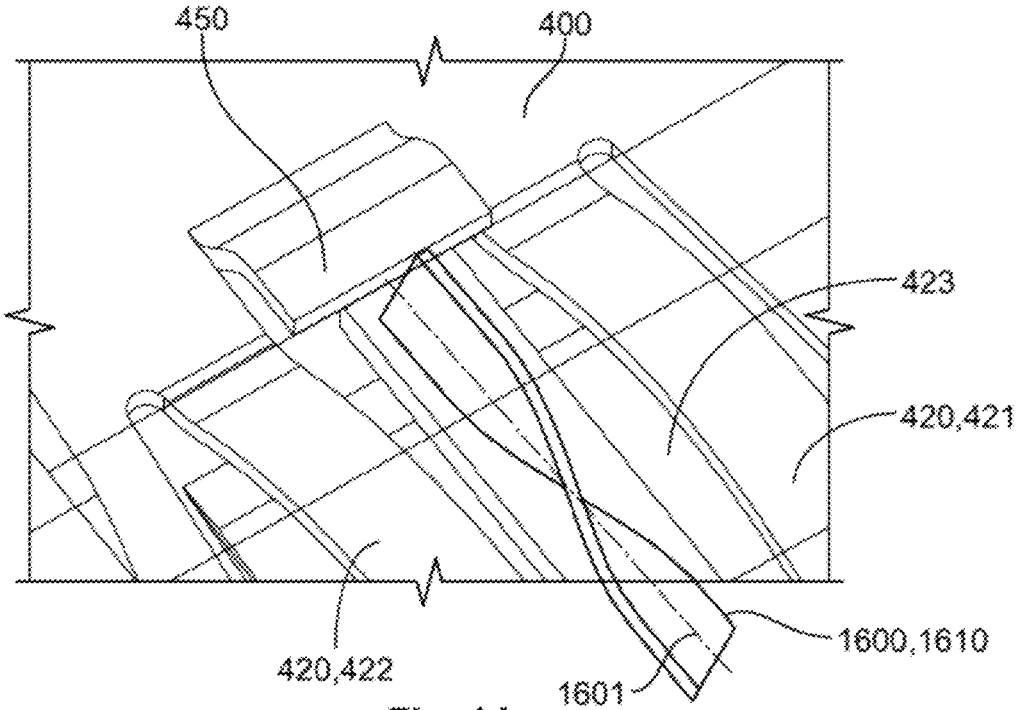
FIG. 14 is a perspective view of the second locking mechanism tool engaging the locking spring.

In an embodiment shown in FIG. 14, the tool engaging tongue 450 of the locking spring 400 is engaged with the twisted blade 1610, where the blade 1610 is in abutment with the tool engaging tongue 450. The opening 370 in the catch spring 300 has a cross-section which corresponds to the cross-section of the bar-like twisted blade 1610. If the twisted blade 1610 is introduced through the opening 370 of the catch spring 300 into the plug connector 100, the twisting of the twisted blade 1610 when the twisted blade 1610 is introduced into the plug connector 100 brings about a rotation of the twisted blade 1610 about the longitudinal axis 1601. The twisted blade 1610 thereby strikes the tool engaging tongue 450 of the locking spring 400 at an angle. The twisted blade 1610 twists, for example, through an angle of 90° so that the bar-like twisted blade 1610 strikes the tool engaging tongue 450 of the locking spring 400 at an angle of 90°. Contact between the twisted blade 1610 and the tool engaging tongue 450, followed by an application of force to the tool engaging tongue 450 is thereby simplified by the second locking mechanism tool 1600. In addition, in order to move the locking spring 400 from the locking position 401 into the open position 402, only the second locking mechanism tool 1600 can be used. To this end, it is advantageous to construct the tool engaging tongue 450, as illustrated, in a raised manner through the use of a bent portion in order to support interaction with the twisted blade 1610 and to make interaction with other tools more difficult.

In an embodiment (not shown), the socket mating connector 500 lacks the collar 520 and consequently lacks the latches 530, 540. In this embodiment, the catch spring 300 of the plug connector 100 engages at another location of the socket mating connector 500. The insertion and engagement of the plug connector 100 in the socket mating connector 500 occurs while the locking spring 400 of the plug connector 100 is already located in the locking position 401. In order to unlock the catch spring 300 and to separate the plug connector 100 from the socket mating connector, the steps explained with reference to the embodiments in FIGS. 8 to 14 are followed in order to move the locking spring 400 beforehand into the open position 402.

What is claimed is:

1. A plug connector comprising:
a housing having a catch projection;
a locking spring connected to the housing, having a locking position and an open position, the locking spring having a projection engaging tongue engaging the catch projection when the locking spring is in the open position; and
a catch spring connected to the housing, having
a compressed position when the locking spring is in the open position, and
a rest position when the locking spring is in the open position.

2. The plug connector according to claim 1, wherein the locking spring is positioned between the housing and the catch spring.

3. The plug connector according claim 1, wherein the locking spring has a wing preventing a movement of the catch spring into the compressed position when the locking spring is in the locking position.

4. The plug connector according to claim 1, wherein the locking spring is independently displaced from the open position to the locking position when the projection engaging tongue is disengaged from the catch projection.

5. The plug connector according to claim 4, wherein the locking spring has a resilient element that is resiliently distorted when the locking spring is in the open position.

6. The plug connector according to claim 1, wherein the plug connector has a tool receiving opening through which a complimentarily-shaped tool is positioned when the locking spring transitions from the locking position into the open position.

7. The plug connector according to claim 6, wherein the tool receiving opening is positioned on the catch spring.

8. The plug connector according to claim 1, wherein the plug connector is an RJ plug connector.

9. A plug connector system comprising:
a plug connector having:
a housing having a catch projection,
a locking spring connected to the housing, having a locking position and an open position, the locking spring having a projection engaging tongue engaging the catch projection when the locking spring is in the open position, and
a catch spring connected to the housing, having
a compressed position when the locking spring is in the open position, and
a rest position when the locking spring is in the open position; and
a complimentary socket mating connector.

10. The plug connector system according to claim 9, wherein the socket mating connector has a latch.

11. The plug connector system of claim 10, wherein the latch is engaged by the catch spring when the plug connector and the socket mating connector are mated, and when the catch spring is in the rest position.

12. The plug connector system of claim 11, wherein the latch is disengaged from the catch spring when the catch spring is in the compressed position.

13. The plug connector system according to claim 12, wherein the locking spring is independently displaced from the open position to the locking position when the projection engaging tongue is disengaged from the catch projection.

14. The plug connector system according to claim 13, wherein the projection engaging tongue is disengaged from the catch projection by the latch when the plug connector is being mated to the socket mating connector.

15. The plug connector system according to claim 13, wherein the locking spring has a wing preventing a movement of the catch spring into the compressed position when the locking spring is in the locking position.

16. The plug connector system according to claim 15, wherein the latch contacts the wing when the plug connector and the socket mating connector are being mated together.

17. The plug connector system according to claim 9, wherein the plug connector has a tool receiving opening.

18. The plug connector system according to claim 17, further comprising a releasing tool positionable through the tool receiving opening.

19. The plug connector system according to claim 18, wherein the releasing tool is engaged with the locking spring when the locking spring moves from the locking position to the open position.

20. The plug connector system according to claim 18, wherein the releasing tool has a blade that twists about a longitudinal axis.

21. A plug connector comprising:

a housing;

a locking spring connected to the housing, having a locking position and an open position;

a catch spring connected to the housing, having a compressed position when the locking spring is in the open position, and a rest position when the locking spring is in the open position; and a tool receiving opening through which a complimentarily-shaped tool is positioned when the locking spring transitions from the locking position into the open position.

22. The plug connector according to claim 21, wherein the tool receiving opening is positioned on the catch spring.

23. A plug connector system comprising:

a plug connector having:

a housing, a locking spring connected to the housing, having a locking position and an open position, a catch spring connected to the housing, having a compressed position when the locking spring is in the open position, and a rest position when the locking spring is in the open position, and a tool receiving opening;

a complimentary socket mating connector; and a releasing tool positionable through the tool receiving opening and engaging the locking spring when the locking spring moves from the locking position to the open position.

24. The plug connector system according to claim 23, wherein the releasing tool has a blade that twists about a longitudinal axis.

* * * * *